US005082265A

United States Patent [19]

Bergman

[11] Patent Number: 5,082,265

[45] Date of Patent: Jan. 21, 1992

[54] GRIP AUGMENTING BOWLING BALL HANDLING APPARATUS

[76] Inventor: David Bergman, 27319 Aberdeen, Southfield, Mich. 48076

[21] Appl. No.: 725,274

[22] Filed: Jul. 3, 1991

[51] Int. Cl.[5] ..... A63B 69/00

[52] U.S. Cl. ..... 273/54 B; 273/64

[58] Field of Search ..... 273/37, 38, 54 R, 54 B, 273/64

[56] References Cited

U.S. PATENT DOCUMENTS

| | | | |
|---|---|---|---|
| 2,738,192 | 3/1956 | Wells | 273/64 |
| 3,033,567 | 5/1962 | Raab | 273/54 B |
| 3,046,014 | 7/1962 | Abruzzi | 273/64 |
| 3,206,202 | 9/1965 | Evans | 273/64 |
| 3,365,197 | 1/1968 | Root | 273/54 B |
| 3,565,429 | 2/1971 | Williams | 273/64 |
| 3,918,426 | 11/1975 | Privitera | 273/64 X |
| 4,256,305 | 3/1981 | Peterson | 273/64 |
| 4,332,383 | 6/1982 | Milden et al. | 273/64 |

*Primary Examiner*—William H. Grieb
*Attorney, Agent, or Firm*—Brooks & Kushman

[57] ABSTRACT

A bowling ball handling apparatus (10) for enabling persons having limited gripping ability and others interested in an alternate way of bowling to hold and release a bowling ball (12). The apparatus (10) has an arcuate frame (14) to which are affixed a plurality of spaced ball supports (16) which engage a plurality of points on the spherical surface (18) of the ball (12). A clamp lever (20) is pivotally connected to the frame (14) and engages the spherical surface (18) of the ball (12) at a point spaced from the supports (16) to clamp the ball (12) in the apparatus (10) during pick-up and bowling motions. A locking lever (22) is provided for gripping and releasing the ball (12) from the clamp (26) to deliver the ball (12) when bowling. The clamp lever (20) is locked in place by the locking lever (22). Locking lever (22) has a hook (24) which engages the end of a slot formed on the lower surface of the clamp lever (20). The frame (14) has a handle (28) which is gripped by the bowler's hand along with the locking lever (22). The handle (28) and locking lever (22) are held together by the weight of the ball (12) and the grip by the hand during Pick-up and swing motions. The release mechanism is activated by reducing the grip pressure applied to the handle (28) and locking lever (22). A wrist strap (30) is provided to prevent separation of the apparatus from the bowler as the ball is released.

16 Claims, 1 Drawing Sheet

GRIP AUGMENTING BOWLING BALL HANDLING APPARATUS

TECHNICAL FIELD

This invention relates to a device which is clamped onto the spherical surface of a bowling ball to provide a handle which is released from the bowling ball for bowling.

BACKGROUND OF INVENTION

Persons having physical disabilities relating to their hand are in many instances precluded from participating in the sport of bowling. Gripping holes in a bowling ball with a thumb and two fingers is not feasible if a person lacks the gripping strength or otherwise lacks the dexterity required for bowling. Persons who lack a thumb or finger or suffer from muscular or skeletal disorders may not be able to bowl in the normal manner. Many persons who have physical disabilities would be able to participate in the sport of bowling if a more convenient method of handling the bowling ball was available.

Some devices have been developed to allow the handicapped to participate in the sport of bowling. One approach is to provide a propulsion device which rests on the floor of the bowling alley and is pointed towards the bowling pins. The approach eliminates much of the challenge of bowling and is not approved by the Professional Bowlers' Association.

Another approach is to provide a handle which is affixed to the bowling ball and retracts upon release. U.S. Pat. Nos. 4,256,305 and 4,332,383 disclose a retractable handle provided on a bowling ball which can be gripped by a user and retracts upon release. Problems associated with this approach include interference by the handle as the ball rolls down the bowling alley. Further, the device is part of the bowling ball and cannot be adapted to other balls.

Evans U.S. Pat. No. 3,206,202 discloses a bowling ball rolling device wherein a frame having a pair of semi-circular, bent tubes is provided with a pivoted finger to hold the ball in the device until it is released by a trigger. This device requires squeezing the trigger at the moment of release and may encounter accidental release since there is no positive locking of the ball within the device. Any upward displacement of the ball within the device is only resisted by the frictional force preventing pivoting of the finger. In addition, the trigger release is not consonant with conventional bowling techniques.

Williams U.S. Pat. No. 3,565,429 discloses a bowling ball gripping device wherein a handle is provided with finger-like elements which engage holes formed in the bowling ball. Finger-hole engaging members are statically connected to the handle while a moveable thumb-hole engaging member is spring biased to a release position and is locked by thumb pressure applied to a thumb switch. This device is likewise dedicated to particular bowling finger hole patterns and spacing and is not able to be used with a wide variety of bowling balls. The release of thumb pressure is also an unusual manoeuver for bowling. Centrifugal forces and the weight of the ball must be resisted by the thumb release mechanism and could conceivable result in inadvertent release during approach.

Privitera U.S. Pat. No. 3,918,426 discloses a bowling ball propelling mechanism for handicapped persons wherein an arcuate frame having a handle is provided with a ball receiving carriage. The carriage is spring biased relative to the frame and is released by means of a trigger. The spring mounted carriage propels the ball upon release. This device provides propulsion which is difficult to control. The procedure for using the device is unusual in that a trigger must be pulled to release the ball from the mechanism.

These and other problems and disadvantages are overcome by the present invention as will be more fully described below.

DISCLOSURE OF INVENTION

The present invention relates to a bowling ball handling apparatus which is adapted to be held in the hand of a bowler to aid in holding and releasing a bowling ball. The apparatus includes a frame which provides a plurality of spaced bowling ball supports for engaging the spherical surface of the bowling ball. Clamp means engage the spherical surface of the bowling ball at a point spaced from the bowling ball supports on the frame to positively clamp the bowling ball in the apparatus during pick-up and bowling swing motions. The clamping function is maintained simply and naturally by the hand gripping action. A release means for releasing the bowling ball from the clamp means is actuated by partially releasing the grip of the hand of a bowler on the apparatus to allow delivery of the bowling ball.

According to another aspect of the invention, an apparatus for throwing a bowling ball is provided which comprises a frame which provides a plurality of guides for supporting and positioning the bowling ball. A clamp arm is provided to hold the bowling ball against the guides during pick-up and delivery until release of the bowling ball. A lever lock holds the clamp arm in a locked position until release. The locking lever is held in a locking position by the weight of the ball and the grip of the lever by the hand. The bowling ball remains in the locked position for as long as the grip is maintained. To free the bowling ball from its locked position, the bowler releases the grip on the lever and handle, thus removing the pressure on the clamp lever. Without pressure on the clamp lever, the spring forces the clamp lever to swing open, allowing the bowling ball to be thrust in the direction selected by the bowler.

Structurally, the apparatus of the invention includes first and second levers which are pivotally connected to the frame. The first lever is pivotally connected to a distal end of the frame while a second lever is pivotally connected to the frame at a point spaced from the distal end. The second lever has a hand engaged portion and an extension portion which engages the first lever. Biasing means or a spring are connected to the frame and the first lever in order to bias the first lever into a release position. The second lever preferably includes a hook element on the distal end of the extension portion which engages the end of a slot formed on the lower surface of the first lever. The hook holds the first lever in a ball retaining position provided that pressure is applied to the hand engaged portion of the second lever.

The present invention preferably includes the use of a wrist strap for securing the apparatus to the wrist of a bowler to prevent separation of the apparatus from the person when the grip on the apparatus is released. The wrist strap includes a ring of flexible material, a fore strap and an aft strap which extend from the ring of flexible material to the frame forwardly and rearwardly respectively. The ring and fore and aft straps are each adjustable to fix the location of the hand relative to the frame.

These and other objects and advantages of the present invention are described in the following detailed description in view of the attached drawings.

DETAILED DESCRIPTION

Figure 1:
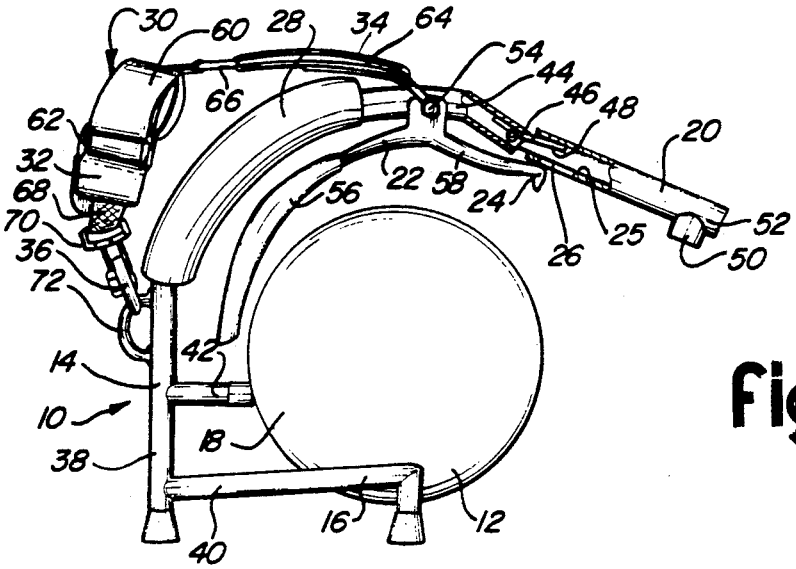
FIG. 1 is a side elevation view of the bowling ball handling apparatus of the present invention.

Referring now to FIG. 1, the bowling ball handling apparatus 10 of the present invention is shown engaging a bowling ball 12.

The apparatus 10 includes a frame 14 which extends partially about the spherical surface of the bowling ball. Ball supports 16 are secured to the frame 14 so as to engage the spherical surface 18 of the bowling ball 12. A clamp lever 20 is connected to the frame 14 and engaged by a locking lever 22. Locking lever 22 includes a hook 24 which engages an end 25 of a slot, or opening 26 formed in the clamp lever 20. A handle 28 is provided on the frame adjacent to the locking lever 22.

A wrist strap 30 forms part of the preferred embodiment of the invention and includes a flexible ring 32 which is connected by a fore strap 34 and aft strap 36 to the frame 14.

The frame 14 is a tubular member having the handle 28 located intermediate to the ends of the frame. A downwardly extending lower portion 38 of the frame is secured at the center to a U-shaped bowling ball rest 40. Ball supports 16 are provided on the ends of the U-shaped assembly. A bowling ball stop 42 forms a third locating point for the bowling ball when placed in the apparatus in conjunction with the two supports 16 formed on the bowling ball rest 40. The front, or distal end 44 of the frame extends forward from the handle 28. Clamp lever 20 is pivotally attached to the distal end of the frame by a pin 46. A helical spring 48 is preferably provided on the pin 46 to bias the locking lever 22 into its upward position. The clamp lever 20 preferably includes a ball engaging element 50 at its distal end 52 which is clamped against the spherical surface 18 of the ball 12.

Locking lever 22 is pivotally connect to the frame intermediate to the length of the frame on a pivot pin 54 mounted at a point spaced rearwardly from the distal end 44 of the frame. A hand grip portion 56 of the locking lever 22 extends rearwardly from the pivot pin 54 and is located adjacent to the handle 28. A forward extension 58 of the locking lever 22 includes the V-shaped hook 24 which locks into the opening slot 26 formed in the lower surface of the clamp lever 20.

Figure 2:
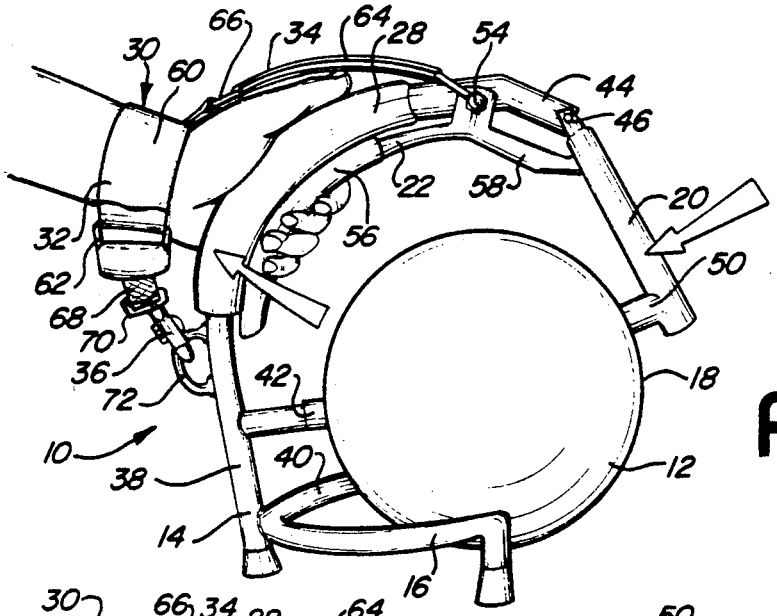
FIG. 2 is a perspective view showing the apparatus, the bowling ball and the hand in a locked position, ready for bowling.

Referring to FIG. 2, when a bowling ball is placed in the apparatus 10 it rests against the ball supports and bowling ball stop. The clamped lever 20 is then clamped over the ball while pressure is applied to the grip portion of the locking lever 22 causing the hook 24 to engage an end of the slot elongated formed shaped opening 26 in the clamp lever 20. Clamp lever 20 is held in its locked position as long as pressure is applied to the hand grip 56 portion of the locking lever 22.

Figure 3:
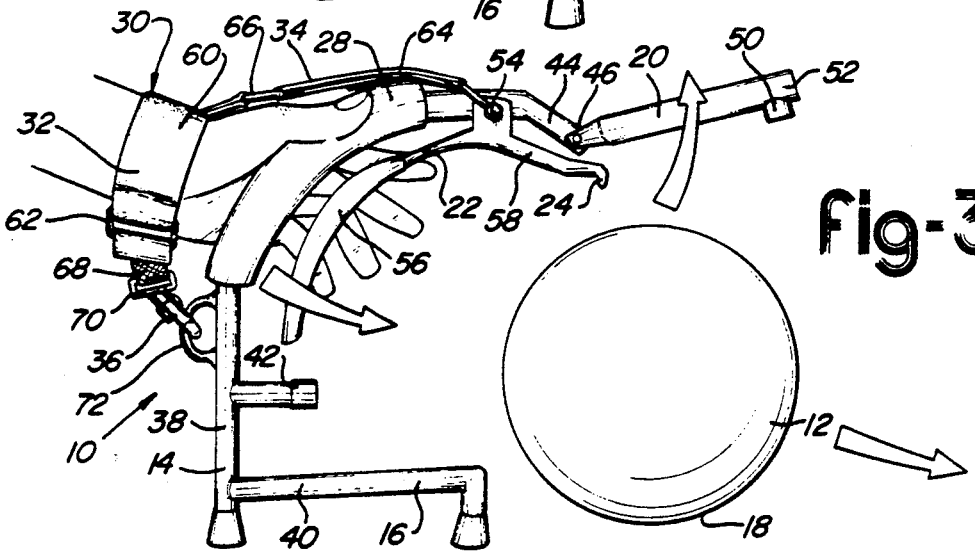
FIG. 3 is a perspective view to show the apparatus in its released position.

When the ball is picked up, the downward force of the ball 12, augmented by the hand gripping force of the lever 22, forces the clamp lever 20 to lock the bowling ball 12 in position. Further, as the apparatus 0 is moved through the bowling motion, centrifugal force exerted by the ball 12 against the frame increases gripping pressure and assures positive locking of the clamp lever 20. It is only at delivery when the bowler intentionally releases pressure from the hand grip, as shown in FIG. 3, in a motion which has similar feel and timing as normal release of a bowling ball. Clamp lever 20 is thereby allowed to spring into its release position for bowling ball delivery.

A wrist strap 30 is provided to ensure retention of the apparatus 10 when the ball is released. Wrist strap 30 includes a ring of flexible material. The ring is preferably adjustable to permit securing it to wrists of various sizes. The ring preferably is made of an elastic padded fabric and includes a VELCRO strap 60 which is adjustably secured to a buckle 62. The ring 32 is secured on its upper end to a fore strap 34. The fore strap 34 is preferably also adjustable by means of a VELCRO strap 64 and buckle 66 and likewise the aft strap 36 includes a VELCRO strap 68 and a buckle 70. By adjusting the length of the fore and aft straps, the wrist orientation relative to the handle 28 can be adjusted for maximum performance and comfort. The fore strap is preferably connected to the pivot pin 54. The aft strap is connected to the frame at a ring 72 which is preferably welded to the lower portion 38 of the frame 14.

In operation, the bowling ball 12 is inserted in the apparatus 10 preferably by placing the apparatus 10 over the bowling ball 12 to contact the supports 16 and stop 42. At this point the clamp lever 20 is pushed against the force of the spring 48 into engagement of the spherical surface 18 of the bowling ball 12. The locking lever 22 is then squeezed against the handle 28 to allow the hook 24 to be received in the opening 26 formed in the lower surface of the clamp lever 20. The apparatus is now in its locked position as shown in FIG. 2 as long as pressure is exerted as shown by the arrow directed towards the grip portion 56 is applied to the grip portion 56. The hook 24 holds down the clamp lever 20 against the bowling ball 12.

When pressure is released from the grip portion 56, as shown in FIG. 3, the hook 24 becomes dislodged from the opening 26 allowing the clamp lever 20 to move into a clearance position in the direction of the arrow shown below the clamp lever in FIG. 3 as the bowling ball exits the apparatus 10 as shown in FIG. 3. The spring 48 forces the clamp lever 20 into its clearance position allowing the ball to move out of the device and freely down the bowling alley.

It will be appreciated that the above description is of a preferred embodiment of the present invention. The preceding description is intended in an illustrative sense while the scope of the invention should be determined by reference to the following claims.

I claim:

1. A bowling ball handling apparatus held in a hand of a bowler for aiding in holding and releasing a bowling ball having a spherical surface comprising:

a frame;

a plurality of spaced bowling ball supports disposed on said frame and engaging a plurality of points on the spherical surface of the bowling ball;

clamp means engaging the spherical surface of the bowling ball at a point spaced from said plurality of points for clamping the bowling ball in said apparatus during pick-up and approach to bowling, said clamping function being maintained by gripping said clamping means in said hand; and release means for releasing the bowling ball from said clamp means by at least partially releasing the grip of the hand of the bowler to allow delivery of the bowling ball from said bowling ball handling apparatus.

2. The bowling ball handling apparatus of claim 1, wherein said clamp means comprises:

a clamp lever pivotally connected to a distal end of said frame;

a locking lever pivotally connected to said frame at a point spaced from said distal end, said locking lever having a hand engaged portion and an extension portion engageable with said clamp lever; and biasing means connected to said frame and said clamp lever for biasing said clamp lever into a release position.

3. The bowling ball handling apparatus of claim 2, wherein said extension portion has a hook formed on the distal end thereof which engages an end of a slot formed in a lower surface of said clamp lever to hold said clamp lever in a ball retaining position provided that pressure is applied to said hand engaged portion.

4. The bowling ball handling apparatus of claim 2, wherein said biasing means is a spring retained on a pivot pin which interconnects said first lever to said frame.

5. The bowling ball handling apparatus of claim 1 further comprising wrist strap means for securing said apparatus to a wrist of said person to prevent separation of said apparatus from said person when said bowling ball is released.

6. The bowling ball handling apparatus of claim 5 wherein said wrist strap means comprises a ring of flexible material, a fore strap extending from said ring to a point on said frame forward of said person's hand, and an aft strap extending from said ring to a point on said frame below said person's hand.

7. The bowling ball handling apparatus of claim 6 wherein said ring is adjustable to be tightened about said person's wrist and said fore and aft straps are adjustable to fix the location of said ring relative to said frame.

8. The bowling ball handling apparatus of claim 1 wherein said frame has a handle grip disposed adjacent to a hand engaged portion of said locking lever which is gripped by said person's hand with fingers partially encircling said handle grip and hand eng. ged portion of said locking lever.

9. An apparatus for throwing a bowling ball comprising:

a frame;

a plurality of guide prongs provided on said frame and being adapted to support the bowling ball;

a clamp lever adapted to hold the bowling ball against said guide prongs during pick-up and delivery of said bowling ball until time for release of the bowling ball; and a locking lever adapted to be gripped by a person, said locking lever holding said clamp lever in a locked position until time for release of the bowling ball, said locking lever being held in a locking position by the weight of said bowling ball when said bowling ball is carried thereby and being held in said locking position during delivery of said bowling ball by centrifugal force, said locking lever being released to unlock said clamp lever by relaxing the grip of the hand holding said apparatus causing the release of the bowling ball from the apparatus at a selected time.

10. The bowling ball handling apparatus of claim 9, wherein said clamp means comprises:

a clamp lever pivotally connected to a distal end of said frame;

a locking lever pivotally connected to said frame at a point spaced from said distal end, said locking lever having a hand engaged portion and an extension portion adapted to engage said clamp lever; and biasing means connected to said frame and said clamp lever for biasing said clamp lever into a release position.

11. The bowling ball handling apparatus of claim 10, wherein said extension portion has a hook formed on a distal end thereof which engages an end of a slot formed in a lower surface of said clamp lever to hold said clamp lever in a ball retaining position provided that pressure is applied to said hand engaged portion.

12. The bowling ball handling apparatus of claim 10, wherein said biasing means is a spring retained on a pivot pin which interconnects said clamp lever to said frame.

13. The bowling ball handling apparatus of claim 9 further comprising wrist strap means for securing said apparatus to a wrist of said person to prevent separation of said apparatus from said person when said bowling ball is released.

14. The bowling ball handling apparatus of claim 13 wherein said wrist strap means comprises a ring of flexible material, a fore strap extending from said ring to a point on said frame forward of said person's hand, and an aft strap extending from said ring to a point on said frame below said person's hand.

15. The bowling ball handling apparatus of claim 14 wherein said ring is adjustable to be tightened about said person's wrist and said fore and aft straps are adjustable to fix the location of said ring relative to said frame.

16. The bowling ball handling apparatus of claim 9 wherein said frame has a handle grip disposed adjacent said locking lever which is gripped by said person's hand with fingers partially encircling said handle grip and said locking lever.

* * * * *